US005711461A

United States Patent [19]

Foster et al.

[11] Patent Number: 5,711,461

[45] Date of Patent: Jan. 27, 1998

[54] LIQUID DISPENSER

[75] Inventors: Donald D. Foster, St. Charles; Philip L. Nelson, Ellisville, both of Mo.

[73] Assignee: Contico International, Inc., St. Louis, Mo.

[21] Appl. No.: 744,223

[22] Filed: Nov. 12, 1996

Related U.S. Application Data

[63] Continuation of Ser. No. 534,720, Sep. 27, 1995, abandoned.

[51] Int. Cl.[6] ..... B67D 5/42

[52] U.S. Cl. ..... 222/383.1

[58] Field of Search ..... 222/341, 383.1, 222/382; 239/333

[56] References Cited

U.S. PATENT DOCUMENTS

| | | | |
|---|---|---|---|
| 3,237,571 | 3/1966 | Corsette . | |
| 3,514,017 | 5/1970 | Malone . | |
| 3,527,388 | 9/1970 | Cooprider . | |
| 3,596,808 | 8/1971 | Corsette . | |
| 3,669,316 | 6/1972 | Corsette . | |
| 3,774,849 | 11/1973 | Boris . | |
| 3,897,006 | 7/1975 | Tada . | |
| 3,918,611 | 11/1975 | Ewald . | |
| 4,051,983 | 10/1977 | Anderson . | |
| 4,153,203 | 5/1979 | Tada . | |
| 4,189,064 | 2/1980 | O'Neill et al. . | |
| 4,230,277 | 10/1980 | Tada . | |
| 4,273,268 | 6/1981 | Wickenberg . | |
| 4,435,135 | 3/1984 | Knickerbocker . | |
| 4,527,741 | 7/1985 | Garneau | 222/383.1 |
| 4,669,664 | 6/1987 | Garneau . | |
| 4,747,523 | 5/1988 | Dobbs . | |
| 4,958,754 | 9/1990 | Dennis . | |
| 5,344,053 | 9/1994 | Foster et al. . | |
| 5,385,302 | 1/1995 | Foster et al. . | |
| 5,425,476 | 6/1995 | Montaner et al. . | |
| 5,425,482 | 6/1995 | Foster et al. . | |
| 5,464,130 | 11/1995 | Tasaki | 222/383.1 |
| 5,507,437 | 4/1996 | Foster et al. . | |
| 5,560,520 | 10/1996 | Grogen . | |
| 5,622,317 | 4/1997 | Foster et al. | 222/383.1 |

FOREIGN PATENT DOCUMENTS

| | | |
|---|---|---|
| 0 295 767 | 12/1988 | European Pat. Off. . |
| 0 437 131 A1 | 1/1990 | European Pat. Off. . |
| 0 453 387 A1 | 10/1991 | European Pat. Off. . |
| 0 516 472 A1 | 12/1992 | European Pat. Off. . |

*Primary Examiner*—Philippe Derakshani
*Attorney, Agent, or Firm*—Howell & Haferkamp, L.C.

[57] ABSTRACT

A liquid dispenser comprising a dispenser body, a check valve, a pressure regulating valve, and a pump piston. The dispenser body has a generally cylindric inner surface defining at least part of a pump chamber, an intake port for fluid communication with a source of liquid, an intake liquid flow path providing fluid communication between the intake port and pump chamber, a discharge port, and a discharge liquid flow path providing fluid communication between the pump chamber and discharge port. The check valve checks fluid flow from the pump chamber to the intake port. The pump piston has a head at its inner end reciprocally slidable within and in sealing engagement with the pump chamber between first and second positions. A vent passageway is defined at least in part by both the dispenser body and pump piston for venting air from the fluid receiving cavity. The dispenser body and pump piston are shaped and configured for opening the vent passageway when the pump piston is in its second position and for blocking the vent passageway when the pump piston is in its first position. When air is in the fluid receiving cavity, movement of the pump piston from its first position to its second position opens the vent passageway to permit air to vent therethrough and prime the pump.

31 Claims, 4 Drawing Sheets

LIQUID DISPENSER

This is a continuation of application Ser. No. 08/534,720 filed on Sep. 27, 1995 now abandoned.

BACKGROUND OF THE INVENTION

This invention relates to a liquid dispenser and more particularly to a pump-type dispenser.

A pressure buildup sprayer is a general type of sprayer in which liquid dispensed from the sprayer is raised to a certain pressure level before it is dispensed from the sprayer. Typically, such a sprayer has a manually operated pump which draws liquid from a source of liquid (e.g., a container) and dispenses it through a nozzle via a liquid flow path. A pressure regulating valve within the liquid flow path and downstream of the pump prevents the flow of liquid to the nozzle until the liquid is raised to at least a minimum fluid pressure level. When the fluid pressure reaches the minimum level, the pressure regulating valve opens to permit liquid to be dispensed through the pressure regulating valve and out the nozzle.

To atomize relatively viscous fluids (e.g., cooking oils), it is necessary that the minimum pressure level be sufficiently high. Depending upon the viscosity of the liquid being dispensed and the pattern of spray or stream desired, this minimum pressure will vary. If the pressure is not sufficiently high, then the dispensed liquid will not be atomized, i.e., it will not be dispensed as a spray.

In prior art pressure buildup sprayers, it is often difficult to prime the pump of the sprayer (i.e., displace air in the pump chamber with liquid from the source of liquid). Because of the compressibility of the air in the pump chamber, actuation of the pump does not sufficiently increase the pressure of the air to Overcome the biasing force of the pressure regulating valve and open the valve. If the air is not removed from the pump chamber, the sprayer cannot operate.

SUMMARY OF THE INVENTION

Among the several objects of the present invention may be noted the provision of an improved pump-type dispenser; the provision of such a dispenser which vents air from the pump chamber remote from the pressure regulating valve of the dispenser; the provision of such a dispenser capable of atomizing relatively viscous fluids; and the provision of such a dispenser which is of relatively simple construction.

In general, a liquid dispenser of the present invention comprises a dispenser body, a check valve, a pressure regulating valve, and a pump piston. The dispenser body has a generally cylindric inner surface, a pump chamber defined at least in part by the cylindric inner surface, an intake port adapted for fluid communication with a source of liquid, an intake liquid flow path providing fluid communication between the intake port and pump chamber, a discharge port, and a discharge liquid flow path providing fluid communication between the pump chamber and discharge port.

The check valve is in the intake liquid flow path. It is configured for permitting fluid flow from the intake port to the pump chamber and for checking fluid flow from the pump chamber to the intake port.

The pressure regulating valve is in the discharge liquid flow path and is moveable between open and closed positions. In the closed position, the pressure regulating valve blocks fluid flow between the pump chamber and discharge port. In the open position, the pressure regulating valve permits fluid to flow from the pump chamber through the discharge liquid flow path and out the discharge port.

The pump piston has a head at its inner end slidable within the pump chamber. The head is configured for sealing engagement with the cylindric inner surface of the dispenser body all around the head of the piston to seal against leakage of fluid between the cylindric inner surface of the dispenser body and the head of the piston. The head of the piston and pump chamber define a variable volume fluid receiving cavity. The pump piston is reciprocally slidable in the pump chamber between a first position in which the fluid receiving cavity has a first volume $V_1$ and a second position in which the fluid receiving cavity has a second volume $V_2$ smaller than the first volume $V_1$. A vent passageway is defined at least in part by both the dispenser body and pump piston for venting air from the fluid receiving cavity. The dispenser body and pump piston are shaped and configured for opening the vent passageway when the pump piston is in its second position and for blocking the vent passageway when the pump piston is in its first position. When air is in the fluid receiving cavity, movement of the pump piston from its first position to its second position increases pressure within the fluid receiving cavity to force the air through the vent passageway and thereby prime the pump. After air has been evacuated from the fluid receiving cavity, movement of the pump piston from its second position to its first position creates a vacuum pressure in the fluid receiving cavity to draw liquid from the source of liquid through the check valve and into the fluid receiving cavity. When the fluid receiving cavity is filled with liquid, movement of the pump piston from its first position toward its second position forces the liquid through the pressure regulating valve and through the discharge port.

In another aspect of the present invention, a liquid dispenser comprises a dispenser body, a check valve, a pressure regulating valve, and a pump piston. A vent passageway is defined at least in part by at least one of the dispenser body and pump piston for venting air from the fluid receiving cavity. The dispenser body includes a portion engageable with the pump piston when the pump piston is in its second position. The pump piston and the portion of the dispenser body are configured such that engagement of the pump piston with the portion of the dispenser body opens the vent passageway. The vent passageway is blocked when the pump piston is in its first position. Movement of the pump piston from its first position to its second position when air is in the fluid receiving cavity increases pressure within the fluid receiving cavity to force the air through the vent passageway and thereby prime the pump. Movement of the pump piston from its second position to its first position after air has been evacuated from the fluid receiving cavity creates a vacuum pressure in the fluid receiving cavity to draw liquid from the source of liquid through the check valve and into the fluid receiving cavity. Movement of the pump piston from its first position toward its second position when the fluid receiving cavity is filled with liquid causes the liquid to be forced through the pressure regulating valve and through the discharge port.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
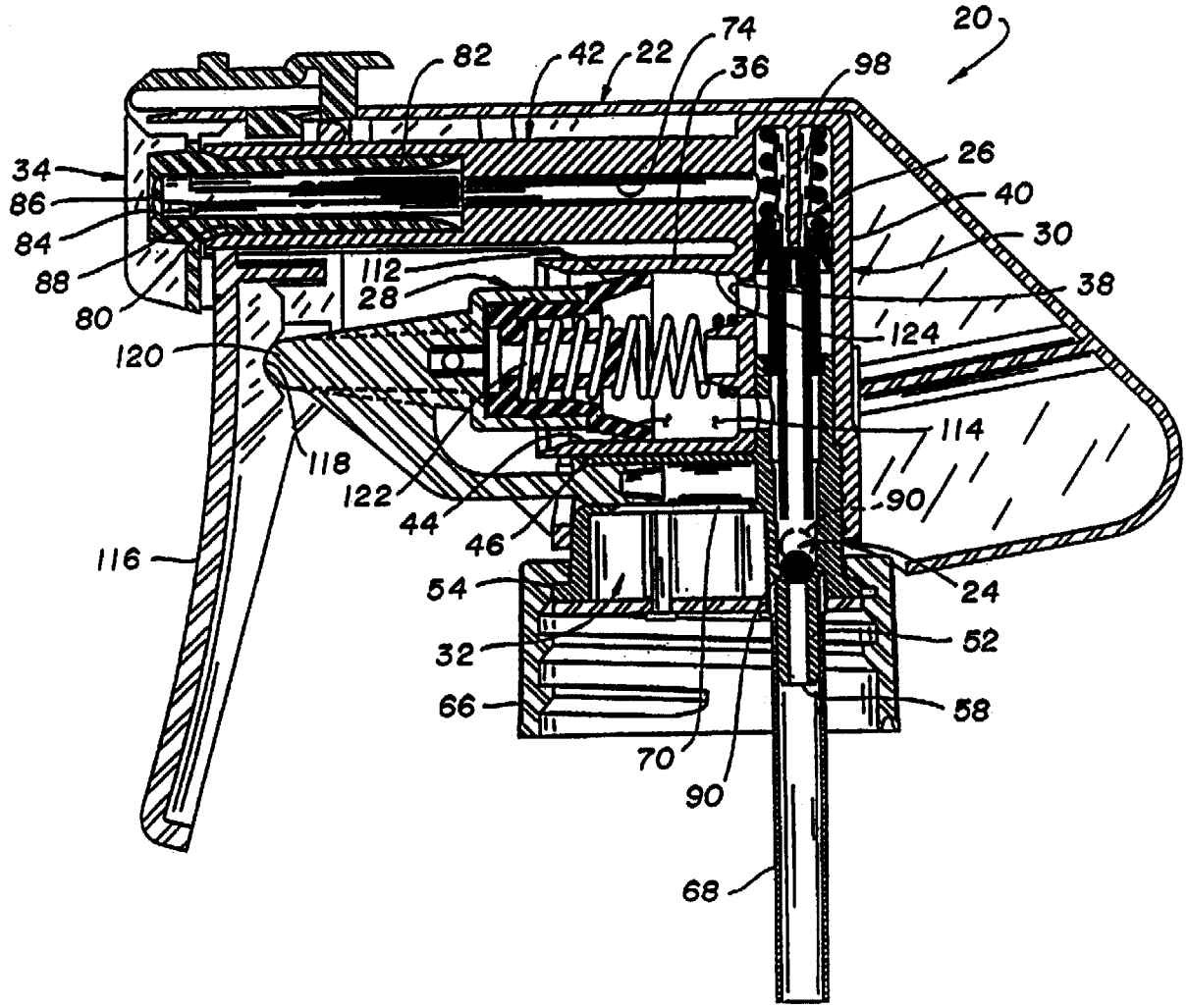
FIG. 1 is a side elevational view, in section, of a liquid dispenser of the present invention.

Referring now to the drawings, and first more particularly to FIG. 1, a spray-type dispenser of the present invention is indicated in its entirety by the reference numeral 20. The dispenser 20 comprises a dispenser body, generally indicated at 22, a ball-type check valve, generally indicated at 24, a pressure regulating valve, generally indicated at 26, and a pump piston generally indicated at 28. The dispenser body 22 comprises an upper housing member, generally indicated at 30, a lower housing member, generally indicated at 32, and a nozzle head, generally indicated at 34. Preferably, each of these components is of a polymeric material. However, it is to be understood that some or all of the components may be of other materials without departing from the scope of this invention.

The upper housing member 30 of the dispenser body 22 includes a cylindric formation (wall) 36, a circular back wall 38 substantially closing one end (i.e., the right end as viewed in FIG. 1) of the cylindric wall, a generally cylindric vertical formation 40 adjacent the circular back wall, and a horizontal tubular portion 42 extending forward from the vertical formation. The cylindric wall 36 includes a generally cylindric inner surface 44 for slidably receiving the pump piston 28 (described in greater detail below). The inner surface 44 of the cylindric wall 36 and the circular back wall 38 define a pump chamber 46 open at one end (i.e., its left end as viewed in FIG. 1) for slidably receiving the pump piston 28.

Figure 2:
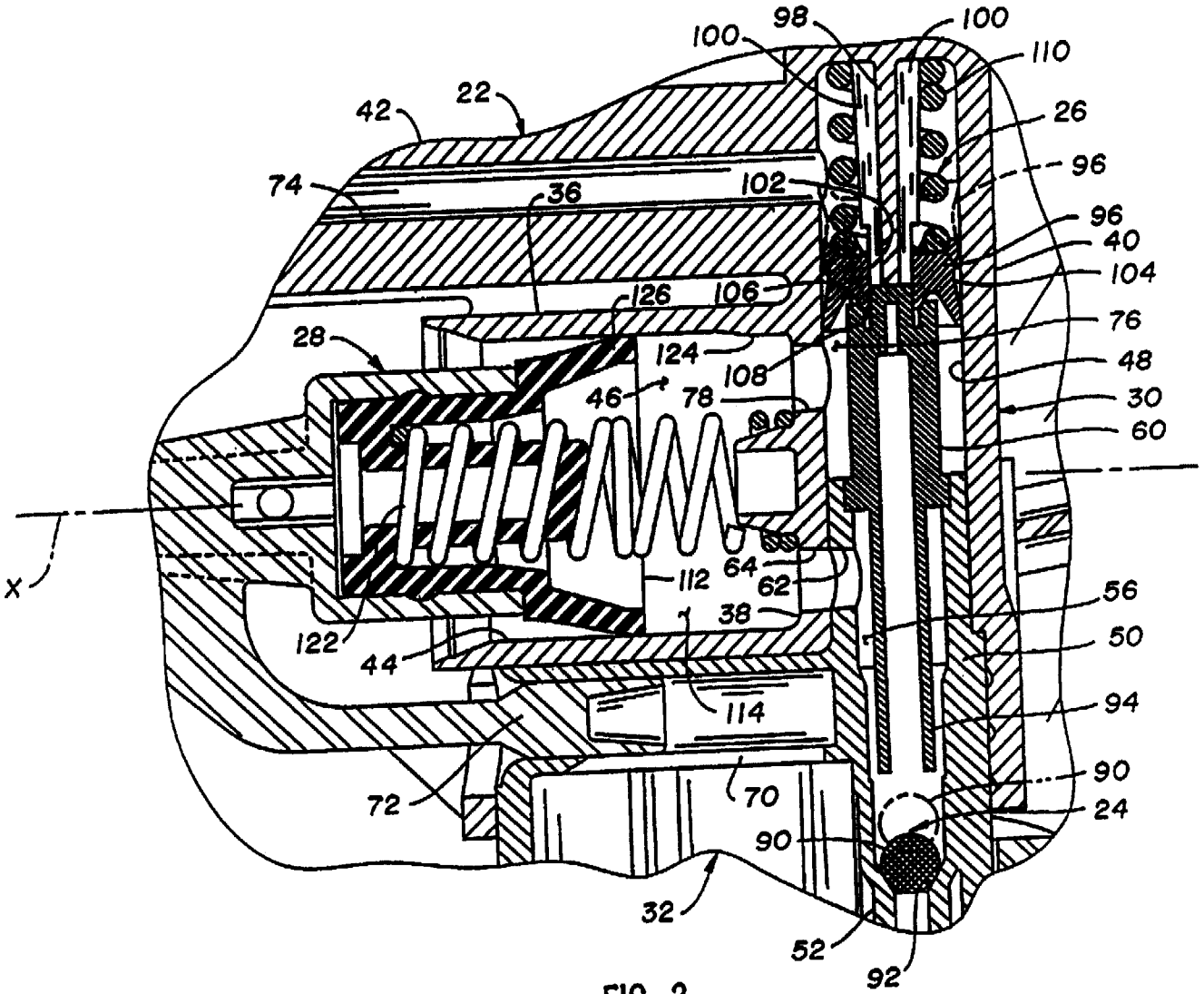
FIG. 2 is an enlarged fragmented view, in section, of a pump mechanism of the liquid dispenser of FIG. 1, showing a pump piston of the mechanism in a retracted position relative to a pump chamber of the mechanism.
Figure 3:
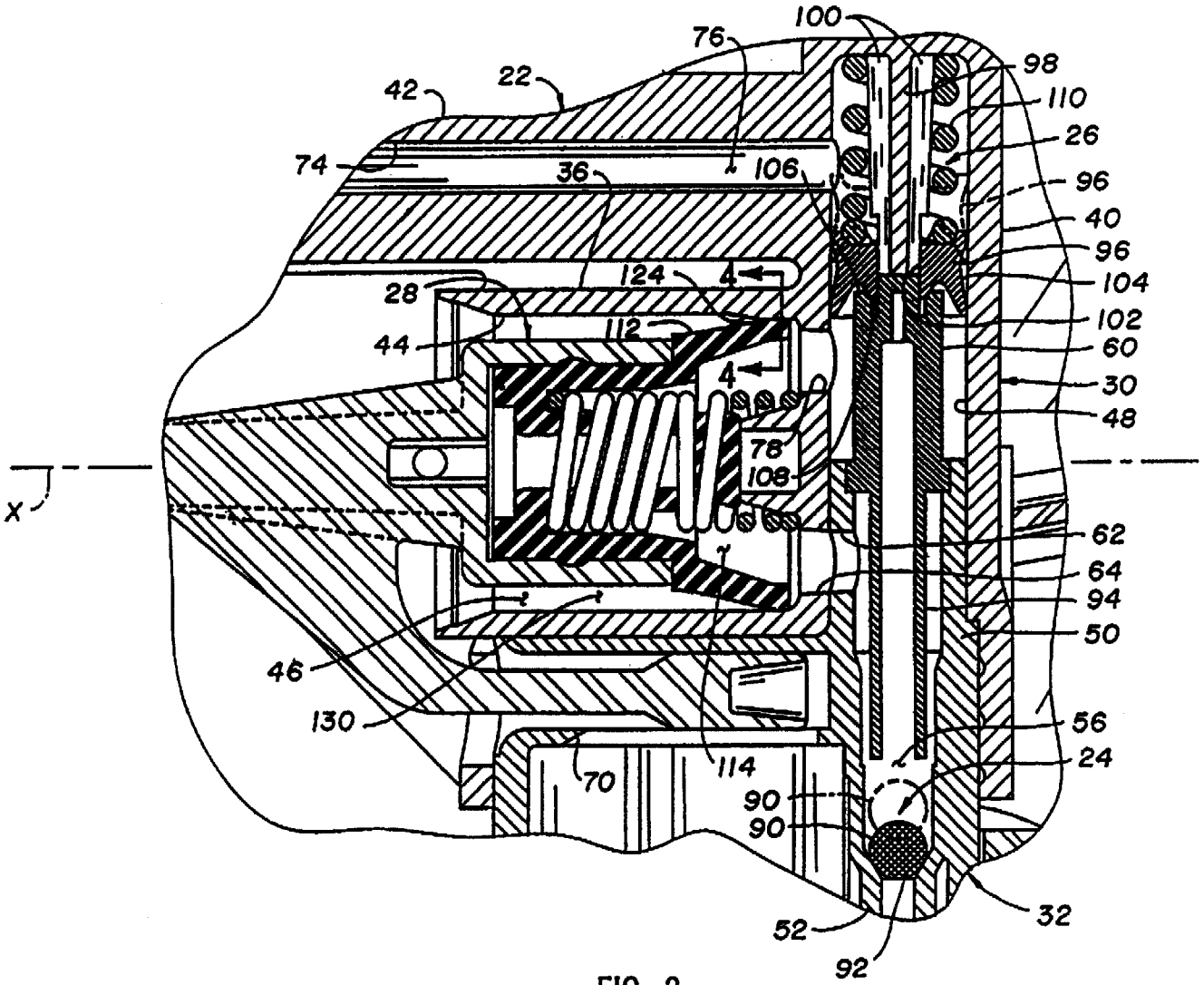
FIG. 3 is an enlarged fragmented view similar to that of FIG. 2 but with the pump piston in an extended position relative to the pump chamber.

The vertical formation 40 of the upper housing member 30 has a vertical bore 48 (FIGS. 2 and 3) extending upward from the bottom of the vertical formation 40. A lower end of the vertical bore 48 receives the lower housing member 32 of the dispenser body 22. More particularly, the lower housing member 32 has a generally cylindric column 50 extending upward into the vertical bore 48 in sealing engagement with the vertical formation 40. The lower housing member 32 also has a nipple 52 (FIG. 1) extending down from the lower end of the cylindric column 50, and an annular flange 54. The nipple 52 and cylindric column 50 have inner surfaces defining an intake liquid flow path 56 (FIGS. 2 and 3). The lower end of the nipple 52 defines an intake port 58 for the intake liquid flow path 56. Preferably, an elongate stem 60 is downwardly press fit into the upper end of the cylindric column 50 to plug the upper end and thereby prevent liquid to pass through the upper end of the cylindric column. A lateral opening 62 through the wall of the cylindric column 50 is aligned with an intake opening 64 through the circular back wall 38 of the upper housing member 30 to provide fluid communication between the intake liquid flow path 56 and the pump chamber 46. Thus, liquid flowing upward through the intake port 58 passes through the intake liquid flow path 56 through the aligned openings 62, 64 and into the pump chamber 46.

Preferably a threaded collar 66 (or cap) is retained on the lower housing member 32 via the annular flange 54 for receiving a threaded neck of a liquid bottle (not shown). A dip tube 68 is sealingly engaged by and depends from the lower end of the nipple 52. The dip tube 68 is adapted to extend downward into liquid (not shown) within the bottle. The dip tube 68 constitutes a conduit for transporting liquid from the bottle to the intake port 58 of the intake liquid flow path 56. Although the dispenser 20 preferably has a generally straight dip tube extending down into a bottle, it is to be understood that a long flexible tube could alternatively extend from the nipple to a source of liquid remote from the sprayer.

Preferably, a bottle vent opening 70 is in the lower housing member 32 for opening the top of the bottle to atmosphere. A plug 72 (FIGS. 2 and 3) is integrally connected to the pump piston 28 and moveable therewith. The plug 72 is adapted for closing the bottle vent opening 70 when the dispenser 20 is not in use to prevent liquid from spilling out of the bottle via the opening.

The horizontal tubular portion 42 of the upper housing member 30 includes a horizontal bore 74 extending axially therethrough and in fluid communication with an upper end of the vertical bore 48 of the vertical formation 40. The vertical and horizontal bores 48, 74 comprise a discharge liquid flow path 76. A discharge opening 78 through the circular back wall 38 of the upper pump chamber 46 provides fluid communication between the pump chamber and the discharge liquid flow path 76. Liquid in the pump chamber 46 flows out of the discharge opening and through the discharge liquid flow path 76. A nozzle-head receiving socket 80 (FIG. 1) is in the forward end of the horizontal tubular portion 42 for receiving a rearward (upstream) end of the nozzle head 34. The socket 80 is coaxial with the horizontal bore 74 and in fluid communication with the discharge liquid flow path 76 so that liquid flowing through the discharge liquid flow path flows to the nozzle head 34.

The nozzle head 34 comprises a tubular projection 82 inserted into the nozzle-head receiving socket 80 of, the horizontal tubular portion 42, a nozzle wall 84 at a forward (downstream) end of the tubular projection 82, and a nozzle orifice 86 through the nozzle wall and in fluid communication with the interior of the horizontal bore 74. The interior of the tubular projection 82 further defines the discharge liquid flow path 76, and the nozzle orifice 86 constitutes a discharge port of the discharge liquid flow path. Preferably, a fluid spinner 88 is contained in the interior of the tubular projection 84 of the nozzle head 34. The fluid spinner 88 imparts a swirl to liquid flowing forward through the nozzle head 34 to dispense the liquid from the discharge port in a spray pattern.

The check valve 24 comprises a ball 90, and an annular valve seat 92 formed in the lower housing member 32 in the intake liquid flow path 56. The ball 90 of the check valve 24 is moveable between a closed position (shown in solid in FIG. 1) and an open position (shown in phantom in FIG. 1). In its closed position, the ball 90 seats against the valve seat 92 to block the intake liquid flow path 56 and thereby check fluid flow from the pump chamber 46 to the intake port 58. In its open position, the ball 90 is spaced above the valve seat 92 to permit liquid to flow upward around the ball and through the intake liquid flow path 56. Preferably, a lower portion 94 of the elongate stem 60 extends downward into the intake liquid flow path 56 and below the lateral opening 62 through the wall of the cylindric column 50 to limit upward movement of the ball 90.

The pressure regulating valve 26 (i.e. pressure buildup valve) comprises a generally annular valve member 96 slidably mounted on a shaft 98 extending downward from an upper end of the vertical formation 40 and into the discharge liquid flow path 76. Preferably, the shaft 98 is X-shaped in horizontal cross section to define four liquid-transporting channels 100 (only two of which are shown in FIGS. 2 and 3). The annular valve member 96 has a generally cylindric inner surface 102 that slides over the shaft 98 but does not block the liquid-transporting channels 100 of the shaft 98. An exterior surface 104 of the annular valve member 96 is in sliding engagement with the cylindrical inner surface of the vertical bore 48. Preferably, the exterior surface 104 of the annular valve member 96 is sized and configured for sealingly engaging the inner surface of the vertical bore 48 to prevent leakage therebetween. Preferably, the annular valve member 96 sealingly engages the surface even when the valve member slides along the shaft 98. The pressure regulating valve 26 further comprises an upwardly facing annular valve seat 106 on the upper end of the cylindric column 50, and a downwardly facing annular sealing surface 108 generally on the bottom of the annular valve member 96 adapted for seating against the valve seat. The annular valve member 96 is moveable between a closed position (shown in solid in FIGS. 2 and 3) and an open position (shown in phantom in FIGS. 2 and 3). In the closed position, the sealing surface 108 of the valve member 96 seats against the valve seat 106 to prevent liquid flow through the discharge liquid flow path 76. In other words, when the pressure regulating valve 26 is closed, the valve member 96 seals against the valve seat 106 to block fluid flow between the pump chamber 46 and discharge port 86. In the open (unseated) position, the sealing surface 108 of the valve member 96 is spaced above the valve seat 106 to permit liquid to flow from the pump chamber 46 through the discharge liquid flow path 76 and out the discharge port 86.

The pressure regulating valve 26 also includes a biasing spring 110 for urging the valve member 96 to its closed position. The biasing spring 110 is preferably a compressed helical spring surrounding the shaft 98 and extending between the upper end of the vertical formation 40 and the upper end of the valve member 96. However, it is to be understood that other types of resilient members and/or arrangements could be employed without departing from the scope of this invention.

The pump piston 28 has a piston head 112 preferably formed of a suitable resilient material such as low density polyethylene. The piston head 112 comprises the rearward end (the right most end as viewed in FIGS. 1–3) of the pump piston 28. The piston head 112 is slidable within the pump chamber 46 and configured for sealing engagement with the cylindric inner surface 44 of the pump chamber 46 all around the piston head 112 to seal against leakage of fluid between the pump piston 28 and cylindric inner surface 44. The piston head 112 and pump chamber 46 define a variable volume fluid receiving cavity 114. The pump piston 28 is reciprocally slidable in the pump chamber 46 generally along an axis X between a first (extended) position and a second (compressed) position. When the pump piston 28 is in its extended position (shown in FIGS. 1 and 2), the fluid receiving cavity 114 has a first (extended) volume $V_1$. When the pump piston 28 is in its compressed position (shown in FIG. 3), the fluid receiving cavity 114 has a second (compressed) volume $V_2$ which is smaller than the extended volume $V_1$.

Preferably, the pump piston 28 is moved from its extended position to its compressed position by a trigger 116. The trigger 116 is connected at its upper end (not shown) to the upper housing member 30 for pivotal movement relative to the upper housing member (i.e., clockwise and counter-clockwise movement as viewed in FIG. 1). The trigger 116 has a camming surface 118 engageable with a forward end 120 (i.e., the left most end as viewed in FIG. 1) of the pump piston 28. Counterclockwise movement of the trigger 116 causes the camming surface 118 to push against the pump piston 28 and thereby move the pump piston rearwardly (i.e., from left to right as viewed in FIG. 1). A helical piston spring 122 is positioned between the circular back wall 38 of the pump chamber 46 and the pump piston 28 for urging the pump piston forward to its extended position. Thus, the pump piston 28 is rearwardly moved from its extended position to its compressed position by manually squeezing the trigger 116, and is automatically returned to its extended position via the piston spring 122 when the operator releases the trigger. After the pump has been primed, i.e., after air has been vented from the fluid receiving cavity 114, forward movement of the pump piston 28 along its axis X causes vacuum pressure (i.e., negative pressure) in the fluid receiving cavity 114. This vacuum pressure causes liquid to be drawn from the bottle into the fluid receiving cavity 114 via the dip tube 68, intake port 58, and intake liquid flow path 56. Rearward movement of the pump piston 28 increases the pressure in the fluid receiving cavity 114. This increase in fluid pressure closes the check valve 24, opens the pressure regulating valve 26, and forces liquid out the discharge port 86 via the discharge liquid flow path 76.

To dispense viscous liquids (e.g., cooking oils having a viscosity of 20–30 cps) in a spray pattern, it is necessary that the liquid in the discharge liquid flow path 76 be pressurized to at least a minimum fluid pressure level P. This minimum pressure level will vary depending on the viscosity of the liquid and the discharge pattern of spray or stream desired. If the liquid is not so pressurized, the liquid will exit the discharge port 86 only as a thin stream, if it is discharged at all. Because of this, the biasing spring 110 of the pressure regulating valve 26 preferably has a spring constant sufficient to maintain the valve member 96 of the pressure regulating valve in its closed position when fluid pressure in the fluid receiving cavity 114 is below the minimum fluid pressure level P. This minimum pressure level P is greater than air pressure which could be generated by moving the pump piston 28 from its extended position to its compressed position. In other words, the minimum pressure level P is greater than air pressure which would result from isothermal compression of a given amount of air from the extended volume $V_1$ to the compressed volume $V_2$, assuming that the air is at atmospheric pressure when it is at the first volume $V_1$ and has a temperature of 80° F. Because reciprocation of the pump piston 28 cannot generate sufficient air pressure to open the pressure regulating valve 26, air in the fluid receiving cavity 114 cannot be vented through the discharge liquid flow path 76 and through the discharge port 86.

Figure 4:
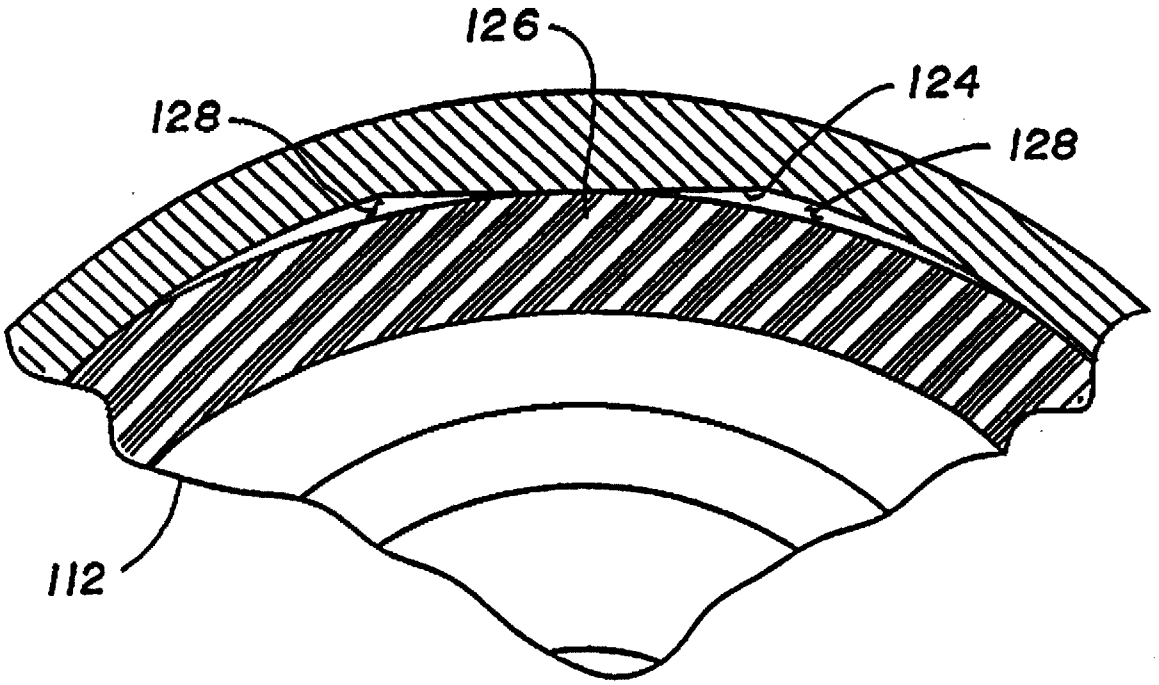
FIG. 4 is a cross-sectional view taken along the plane of line 4—4 of FIG. 3.

To vent air from the fluid receiving cavity 114 and thereby prime the pump, the piston head 112 of the pump piston 28 and the cylindrical inner surface 44 of the pump chamber 46 are configured for providing at least one vent passage therebetween when the pump piston 28 is in its compressed position and for blocking the vent passage when the pump piston 28 is in its extended position. In particular, a ramp 124 is formed on a rearward portion of the cylindrical inner surface 44 of the pump chamber 46. When the pump piston 28 is moved rearward to its compressed position, a portion 126 of the piston head 112 (an upper portion as viewed in FIGS. 3 and 4) engages the ramp 124. The ramp 124 imparts a sufficient lateral force (downward as viewed in FIGS. 3 and 4) against the piston head 112 of the pump piston 28 to elastically (i.e., temporarily) deform the piston head and force the upper portion 126 of the piston head laterally downward. Lateral movement of the upper portion 126 of the piston head 112 breaches the seal between the piston head and the cylindrical inner surface 44 to form two vent passageways 128 (FIG. 4) therebetween. These vent passageways 128 extend axially between the piston head 112 and the cylindrical inner surface 44 to provide fluid communication between the fluid receiving cavity 114 and a forward region 130 (FIG. 3) of the pump chamber 46 which is open to atmosphere when the pump piston 28 is in its compressed position. When the piston head 112 is moved to a position axially forward of the ramp 124, the resilient nature of the head urges the upper portion of the head radially outward back into sealing engagement with the cylindrical inner surface 44 of the pump chamber 46 to close the vent passageways 128. Rearward movement of the pump piston 28 compresses air in the fluid receiving cavity 114 until the piston head 112 engages the ramp 124. When the piston head 112 engages the ramp 124, the upper portion 126 of the piston head moves radially inward to open the vent passageways 128, and the compressed air in the fluid receiving cavity 114 flows forward through the vent passageways into atmosphere to evacuate the fluid receiving cavity. After the compressed air has been vented, forward movement of the pump piston 28 causes the piston head 112 to close the vent passageways 128. Continued forward movement of the head then creates a vacuum pressure in the fluid receiving cavity 114 to draw liquid from the bottle into the fluid receiving cavity.

Although the vent passageways 128 are preferably formed by deformation of the head 112 of the pump piston 28 by the ramp 124, it is to be understood that other types of vent passageways may be employed without departing from the scope of this invention. For example, the ramp could be replaced by a short longitudinally extending groove (not shown) formed in the cylindrical inner surface. In such case, the head of the piston would not need to be deformed and a vent passageway would be defined by the groove and the piston head. Alternatively, a vent passageway (not shown) could comprise a short, small diameter bore extending longitudinally into the wall. The bore would open at a first end into a rearward portion of the pump chamber and open at a second end into a portion of the pump chamber forward of the pump chamber. This vent passageway will provide communication between the fluid receiving chamber and atmosphere when the axial position of the head of the piston is between the first and second ends of the bore. However, formation of the vent passageways by deformation of the piston head 112 is more desirable, because vent passageways formed by such deformation cannot readily become clogged with liquid.

In operation, the spray-type dispenser 20 initially will have air in the fluid receiving cavity 114, but no liquid. The air must be vented to enable the dispenser to dispense liquid. The operator squeezes the trigger 116 to move the pump piston 28 rearward to its compressed position (FIG. 3). Movement of the pump piston 28 to its compressed position opens the vent passageways 128 to vent the air from the fluid receiving cavity 114. Because air pressure within the fluid receiving cavity 114 is insufficient to overcome the biasing force of the biasing spring 110 of the pressure regulating valve 26 when the pump piston 28 is moved to its compressed position, the pressure regulating valve remains closed. The operator then releases the trigger 116 and the piston spring 122 moves the pump piston 28 forward to its extended position. This forward movement of the pump piston 28 after air has been evacuated from the fluid receiving cavity 114 creates a vacuum pressure in the fluid receiving cavity which moves the ball 90 of the check valve 24 up away from the valve seat 92 and draws liquid from the bottle into the fluid receiving cavity via the dip tube 68 and intake liquid flow path 56. When the pump piston 28 reaches its extended position, the liquid in the fluid receiving cavity 114 has a volume of approximately $V_1$. Subsequent rearward movement of the pump piston 28 unseats the valve member 96 of the pressure regulating valve 26 to open the pressure regulating valve and permit pressurized delivery of the liquid through the discharge port 86. Because the liquid is dispensed through the discharge port 86 at a pressure of at least the minimum fluid pressure level P, the liquid will be dispensed in a desired spray pattern.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A liquid dispenser comprising:

a dispenser body having a generally cylindric inner surface, a pump chamber defined at least in part by the cylindric inner surface, an intake port adapted for fluid communication with a source of liquid, an intake liquid flow path providing fluid communication between the intake port and pump chamber, a discharge port, and a discharge liquid flow path providing fluid communication between the pump chamber and discharge port;

a first check valve in the intake liquid flow path configured for permitting fluid flow from the intake port to the pump chamber and for checking fluid flow from the pump chamber to the intake port;

a second check valve in the discharge liquid flow path moveable between a closed position for blocking fluid flow between the pump chamber and discharge port and an open position for permitting fluid to flow from the pump chamber through the discharge liquid flow path and out the discharge port;

a pump piston having a head at its inner end slidable within the pump chamber configured for sealing engagement with the cylindric inner surface of the dispenser body all around the head of the piston to seal against leakage of fluid between the cylindric inner surface of the dispenser body and the head of the piston, the head of the piston and pump chamber defining a variable volume fluid receiving cavity, the pump piston being reciprocally slidable in the pump chamber between a first position in which the fluid receiving cavity has a first volume $V_1$ and a second position in which the fluid receiving cavity has a second volume $V_2$ smaller than the first volume $V_1$, the pump chamber having a region open to atmosphere when the pump piston is in its second position;

a vent passageway defined at least in part by both the dispenser body and pump piston for venting air from the fluid receiving cavity, the dispenser body and pump piston being shaped and configured for opening the vent passageway when the pump piston is in its second position and for blocking the vent passageway when the pump piston is in its first position;

the dispenser body further comprising a portion engageable with the head of the pump piston when the pump piston is in its second position, the head of the pump piston and said portion of the dispenser body being configured such that engagement of the head of the pump piston with said portion of the dispenser body causes deformation of one of the head of the pump piston and the dispenser body to open the vent passageway for venting air from the fluid receiving cavity to said region of the pump chamber;

wherein movement of the pump piston from its first position to its second position when air is in the fluid receiving cavity increases pressure within the fluid receiving cavity to force the air through the vent passageway and thereby prime the pump, movement of the pump piston from its second position to its first position after air has been evacuated from the fluid receiving cavity creates a vacuum pressure in the fluid receiving cavity to draw liquid from said source of liquid through the first check valve and into the fluid receiving cavity, and movement of the pump piston from its first position toward its second position when the fluid receiving cavity is filled with liquid forces the liquid through the second check valve and through the discharge port.

2. The liquid dispenser as set forth in claim 1, wherein:

the second check valve is a pressure regulating valve that moves to its open position in response to the pump piston increasing a pressure of liquid in the pump chamber above a minimum pressure.

3. A liquid dispenser as set forth in claim 1 wherein engagement of the head of the pump piston with said portion of the dispenser body deforms the head of the pump piston to open the vent passageway.

4. A liquid dispenser as set forth in claim 1 wherein said portion of the dispenser body imparts a sufficient force against the head of the pump piston when the pump piston is in its second position to breach the seal between the cylindric inner surface of the dispenser body and the head of the piston and thereby open the vent passageway.

5. A liquid dispenser as set forth in claim 1 wherein the pump piston is slidable between its first and second positions generally along an axis X, said portion of the dispenser body imparting a sufficient lateral force against the head of the pump piston when the pump piston is in its second position to breach the seal between the cylindric inner surface of the dispenser body and the head of the piston and thereby open the vent passageway.

6. A liquid dispenser as set forth in claim 2 further comprising a resilient member applying a biasing force to the pump piston for urging the pump piston to its first position.

7. A liquid dispenser as set forth in claim 6 further comprising trigger pivotally connected to the pump body for pivotal movement of the trigger relative to the pump body between first and second pivot positions, said trigger being operatively connected to the pump piston for manually reciprocating the pump piston between its first and second positions by movement of the trigger between its first and second positions.

8. A liquid dispenser as set forth in claim 2 wherein said pressure regulating valve is configured for moving from its closed position to its open position when fluid pressure in the discharge liquid flow path is elevated to at least a minimum fluid pressure level P.

9. A liquid dispenser as set forth in claim 8 wherein the pressure regulating valve comprises a biasing member for maintaining the pressure regulating valve in its closed position when fluid pressure in the fluid receiving cavity is below the minimum fluid pressure level P.

10. A liquid dispenser as set forth in claim 4 wherein the minimum fluid pressure level P is greater than air pressure which would result from isothermal compression of an amount of air from the first volume $V_1$ to the second volume $V_2$, the amount of air being at atmospheric pressure when it is at the first volume $V_1$ and having a temperature of 80° F.

11. A liquid dispenser as set forth in claim 9 wherein the pressure regulating valve comprises a valve seat, a moveable member moveable between a seated position in which the moveable member seats against the valve seat to seal against passage of fluid through the pressure regulating valve and an unseated position in which the moveable member is spaced from the valve seat to permit passage of fluid through the pressure regulating valve, and a resilient member applying a biasing force to the moveable member for urging the moveable member to its seated position, the moveable member being in its seated position when the pressure regulating valve is in its closed position and in its unseated position when the pressure regulating valve is in its open position.

12. A liquid dispenser as set forth in claim 11 wherein the resilient member of the pressure regulating valve applies a sufficient biasing force against the moveable member of the pressure regulating valve to maintain the moveable member in its seated position when air is in the fluid receiving cavity so that movement of the pump piston from its first position to its second position when air is in the fluid receiving cavity causes the air to be vented through the vent passageway rather than through the pressure regulating valve.

13. A liquid dispenser as set forth in claim 2 wherein the liquid dispenser is a trigger sprayer.

14. A liquid dispenser comprising:

a dispenser body having a generally cylindric inner surface, a pump chamber defined at least in part by the cylindric inner surface, an intake port adapted for fluid communication with a source of liquid, an intake liquid flow path providing fluid communication between the intake port and pump chamber, a discharge port, and a discharge liquid flow path providing fluid communication between the pump chamber and discharge port;

a first check valve in the intake liquid flow path configured for permitting fluid flow from the intake port to the pump chamber and for checking fluid flow from the pump chamber to the intake port;

a second check valve in the discharge liquid flow path moveable between a closed position for blocking fluid flow between the pump chamber and discharge port and an open position for permitting fluid to flow from the pump chamber through the discharge liquid flow path and out the discharge port;

a pump piston having a head at its inner end slidable within the pump chamber configured for sealing engagement with the cylindric inner surface of the dispenser body all around the head of the piston to seal against leakage of fluid between the cylindric inner surface of the dispenser body and the head of the piston, the head of the piston and pump chamber defining a variable volume fluid receiving cavity, the pump piston being reciprocally slidable in the pump chamber between a first position in which the fluid receiving cavity has a first volume $V_1$ and a second position in which the fluid receiving cavity has a second volume $V_2$ smaller than the first volume $V_1$;

a vent passageway defined at least in part by at least one of the dispenser body and pump piston for venting air from the fluid receiving cavity;

the cylindric inner surface including a first region and a second region spaced circumferentially from said first region;

the dispenser body further comprising a portion engageable with the head of the pump piston when the pump piston is in its second position, said portion having a generally flat surface extending from said first region of the cylindric inner surface to said second region of the cylindric inner surface, the head of the pump piston and said portion of the dispenser body being configured such that engagement of the head of the pump piston with said portion of the dispenser body deforms the head of the pump piston to open the vent passageway, said vent passageway being blocked when the pump piston is in its first position;

wherein movement of the pump piston from its first position to its second position when air is in the fluid receiving cavity increases pressure within the fluid receiving cavity to force the air through the vent passageway and thereby prime the pump, movement of the pump piston from its second position to its first position after air has been evacuated from the fluid receiving cavity creates a vacuum pressure in the fluid receiving cavity to draw liquid from said source of liquid through the first check valve and into the fluid receiving cavity, and movement of the pump piston from its first position toward its second position when the fluid receiving cavity is filled with liquid causes the liquid to be forced through the pressure regulating valve and through the discharge port.

15. The liquid dispenser as set forth in claim 14, wherein:

the second check valve is a pressure regulating valve that moves to its open position in response to the pump piston increasing a pressure of liquid in the pump chamber above a minimum pressure.

16. A liquid dispenser as set forth in claim 14 wherein the vent passageway is defined at least in part by both the dispenser body and pump piston.

17. A liquid dispenser as set forth in claim 14 wherein said portion of the dispenser body imparts a sufficient force against the head of the pump piston when the pump piston is in its second position to breach the seal between the cylindric inner surface of the dispenser body and the head of the piston and thereby open the vent passageway.

18. A liquid dispenser as set forth in claim 14 wherein the pump piston is slidable between its first and second positions generally along an axis X, said portion of the dispenser body imparting a sufficient lateral force against the head of the pump piston when the pump piston is in its second position to breach the seal between the cylindric inner surface of the dispenser body and the head of the piston and thereby open the vent passageway.

19. A liquid dispenser as set forth in claim 15 further comprising a resilient member applying a biasing force to the pump piston for urging the pump piston to its first position.

20. A liquid dispenser as set forth in claim 19 further comprising a trigger operatively connected to the pump piston for manually reciprocating the pump piston.

21. A liquid dispenser as set forth in claim 15 wherein said pressure regulating valve is configured for moving from its closed position to its open position when fluid pressure in the discharge liquid flow path is elevated to at least a minimum pressure level P.

22. A liquid dispenser as set forth in claim 21 wherein the pressure regulating valve comprises a biasing member for maintaining the pressure regulating valve in its closed position when fluid pressure in the fluid receiving cavity is below the minimum fluid pressure level P.

23. A liquid dispenser as set forth in claim 22 wherein the minimum fluid pressure level P is greater than air pressure which would result from isothermal compression of an amount of air from the first volume $V_1$ to the second volume $V_2$, the amount of air being at atmospheric pressure when it is at the first volume $V_1$ and having a temperature of 80° F.

24. A liquid dispenser as set forth in claim 22 wherein the pressure regulating valve comprises a valve seat, a moveable member moveable between a seated position in which the moveable member seats against the valve seat to seal against passage of fluid through the pressure regulating valve and an unseated position in which the moveable member is spaced from the valve seat to permit passage of fluid through the pressure regulating valve, and a resilient member applying a biasing force to the moveable member for urging the moveable member to its seated position, the moveable member being in its seated position when the pressure regulating valve is in its closed position and in its unseated position when the pressure regulating valve is in its open position.

25. A liquid dispenser as set forth in claim 24 wherein the resilient member of the pressure regulating valve applies a sufficient biasing force against the moveable member of the pressure regulating valve to maintain the moveable member in its seated position when air is in the fluid receiving cavity so that movement of the pump piston from its first position to its second position when air is in the fluid receiving cavity causes the air to be vented through the vent passageway rather than through the pressure regulating valve.

26. A liquid dispenser as set forth in claim 15 wherein the liquid dispenser is a trigger sprayer.

27. A liquid dispenser as set forth in claim 1 wherein the pump piston is slidable between its first and second positions generally along an axis X, said second check valve being spaced laterally from said axis X.

28. A liquid dispenser as set forth in claim 27 wherein said first check valve is spaced laterally from said axis X.

29. A liquid dispenser as set forth in claim 14 wherein the pump piston is slidable between its first and second positions generally along an axis X, said second check valve being spaced laterally from said axis X.

30. A trigger sprayer comprising:

a dispenser body having a generally cylindric inner surface, a pump chamber defined at least in part by the cylindric inner surface, an intake port adapted for fluid communication with a source of liquid, an intake liquid flow path providing fluid communication between the intake port and pump chamber, a discharge port, and a discharge liquid flow path providing fluid communication between the pump chamber and discharge port;

a first check valve in the intake liquid flow path configured for permitting fluid flow from the intake port to the pump chamber and for checking fluid flow from the pump chamber to the intake port;

a pump piston having a head at its inner end slidable within the pump chamber configured for sealing engagement with the cylindric inner surface of the dispenser body all around the head of the piston to seal against leakage of fluid between the cylindric inner surface of the dispenser body and the head of the piston, the head of the piston and pump chamber defining a variable volume fluid receiving cavity, the pump piston being reciprocally slidable in the pump chamber generally along an axis X between a first position in which the fluid receiving cavity has a first volume $V_1$ and a second position in which the fluid receiving cavity has a .second volume $V_2$ smaller than the first volume $V_1$;

a second check valve in the discharge liquid flow path moveable between a closed position for blocking fluid flow between the pump chamber and discharge port and an open position for permitting fluid to flow from the pump chamber through the discharge liquid flow path and out the discharge port, said second check valve being spaced laterally from said axis X;

a trigger operatively connected to the pump body for pivotal movement of the trigger relative to the pump body between first and second pivot positions, the trigger also being operatively connected to the pump piston in a manner such that pivotal movement of the trigger between its first and second positions causes reciprocating movement of the pump piston between its first and second positions;

a vent passageway defined at least in part by both the dispenser body and pump piston for venting air from the fluid receiving cavity, the dispenser body and pump piston being shaped and configured for opening the vent passageway when the pump piston is in its second position and for blocking the vent passageway when the pump piston is in its first position;

the dispenser body further comprising a portion engageable with the head of the pump piston when the pump piston is in its second position, the head of the pump piston and said portion of the dispenser body being configured such that engagement of the head of the pump piston with said portion of the dispenser body causes deformation of one of the head of the pump piston and the dispenser body to open the vent passageway for venting air from the fluid receiving cavity;

wherein movement of the pump piston from its first position to its second position when air is in the fluid receiving cavity increases pressure within the fluid receiving cavity to force the air through the vent passageway and thereby prime the pump, movement of the pump piston from its second position to its first position after air has been evacuated from the fluid receiving cavity creates a vacuum pressure in the fluid receiving cavity to draw liquid from said source of liquid through the first check valve and into the fluid receiving cavity, and movement of the pump piston from its first position toward its second position when the fluid receiving cavity is filled with liquid forces the liquid through the second check valve and through the discharge port.

31. A trigger sprayer as set forth in claim 30 wherein the pump chamber includes a region open to atmosphere when the pump piston is in its second position, the head of the pump piston and said portion of the dispenser body being configured to vent air from the fluid receiving cavity to said region of the pump chamber via the vent passageway when the pump piston is in its second position.

* * * * *